US005810234A

United States Patent [19]

Bürli

[11] Patent Number: 5,810,234

[45] Date of Patent: Sep. 22, 1998

[54] DISPENSING DEVICE FOR BAGS

[75] Inventor: Hugo Bürli, Fürigen, Switzerland

[73] Assignee: Burli Spiel-Und Sportgerate AG, St. Erhard, Switzerland

[21] Appl. No.: 638,874

[22] Filed: Apr. 29, 1996

Related U.S. Application Data

[63] Continuation of Ser. No. 190,003, filed as PCT/CH93/00121, May 13, 1993, abandoned.

[30] Foreign Application Priority Data

May 26, 1992 [CH] Switzerland ..... 1 688/92
Feb. 1, 1993 [CH] Switzerland ..... 00 286/93

[51] Int. Cl.[6] ..... B26F 3/02

[52] U.S. Cl. ..... 225/106; 225/42

[58] Field of Search ..... 225/106, 52, 51, 225/72, 39, 47

[56] References Cited

U.S. PATENT DOCUMENTS

| | | | |
|---|---|---|---|
| 1,934,185 | 11/1933 | Gilliam | 225/51 |
| 1,967,422 | 7/1934 | Nadelson | 225/51 |
| 2,606,724 | 8/1952 | Hertz | 225/47 |
| 2,929,540 | 3/1960 | Carey | 225/51 |
| 2,969,169 | 1/1961 | Botnick | 225/51 |
| 3,040,943 | 6/1962 | Bump | 225/52 |
| 3,702,672 | 11/1972 | Becht | 225/106 |
| 4,073,419 | 2/1978 | Tarrson et al. | 225/51 |
| 4,535,912 | 8/1985 | Bonk | 225/106 |
| 4,738,384 | 4/1988 | Tigner | 225/52 |
| 4,930,385 | 6/1990 | Wilfong, Jr. et al. | 225/106 |
| 5,325,992 | 7/1994 | Koller et al. | 225/106 |

FOREIGN PATENT DOCUMENTS

| | | | |
|---|---|---|---|
| 11641 | 7/1890 | United Kingdom | 225/51 |

*Primary Examiner*—Kenneth E. Peterson
*Attorney, Agent, or Firm*—Jacobson, Price, Holman & Stern, PLLC

[57] ABSTRACT

The dispensing device comprises a housing (1) which consists of two parts. This housing contains a base plate (2) and an upper part (3), the upper part (3) being designed as a lid whose opening can be placed onto the base plate. On the underside of the base plate (2), a column (5) is attached. The upper part (3) is articulatedly mounted on the base plate (2) with the aid of a hinge (4). The supply of bags forms rolls (37) and such a supply of bags is located in the upper part (3). That wall (11 or 13, respectively) of the upper part (3) closest to the roll (37) in question is provided with a slot (20) through which the bags can leave the housing. A device (40) for the support of the rolls (37) is provided which is arranged in the upper part (3). This support device (40) comprises at least one pair of holders (42) for a supply roll (37).

This dispensing device may also be set up outdoors.

13 Claims, 5 Drawing Sheets

FIG. 3
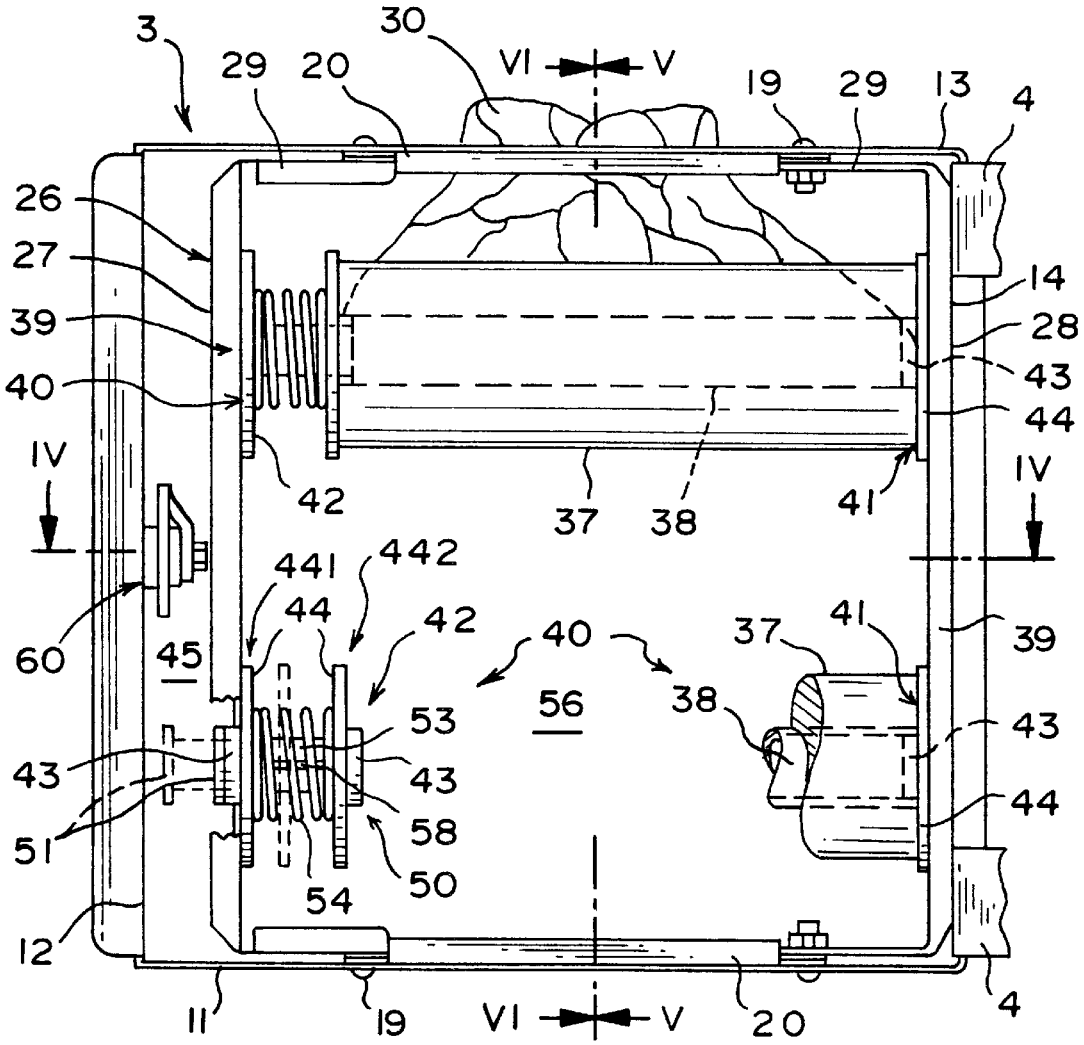
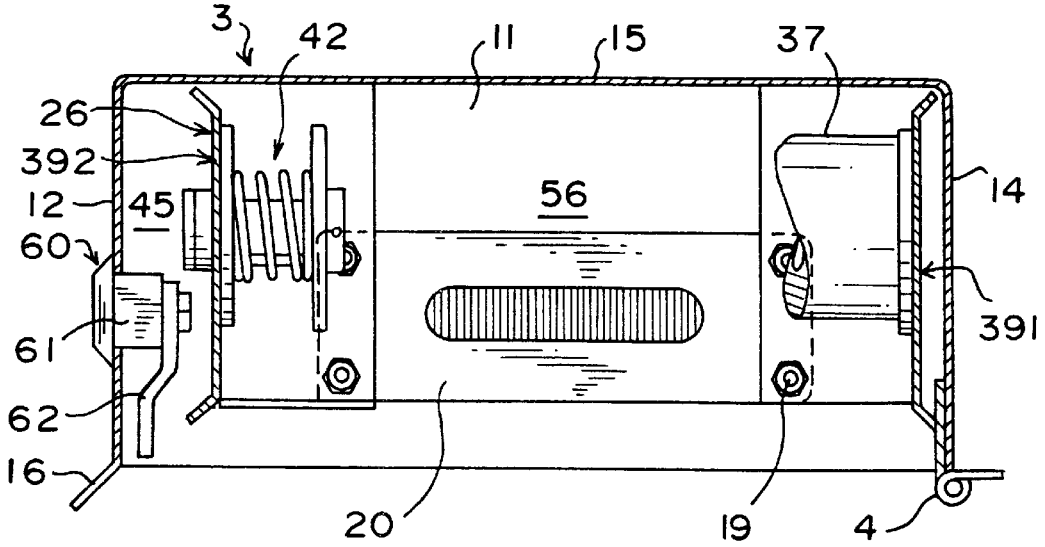
FIG. 4

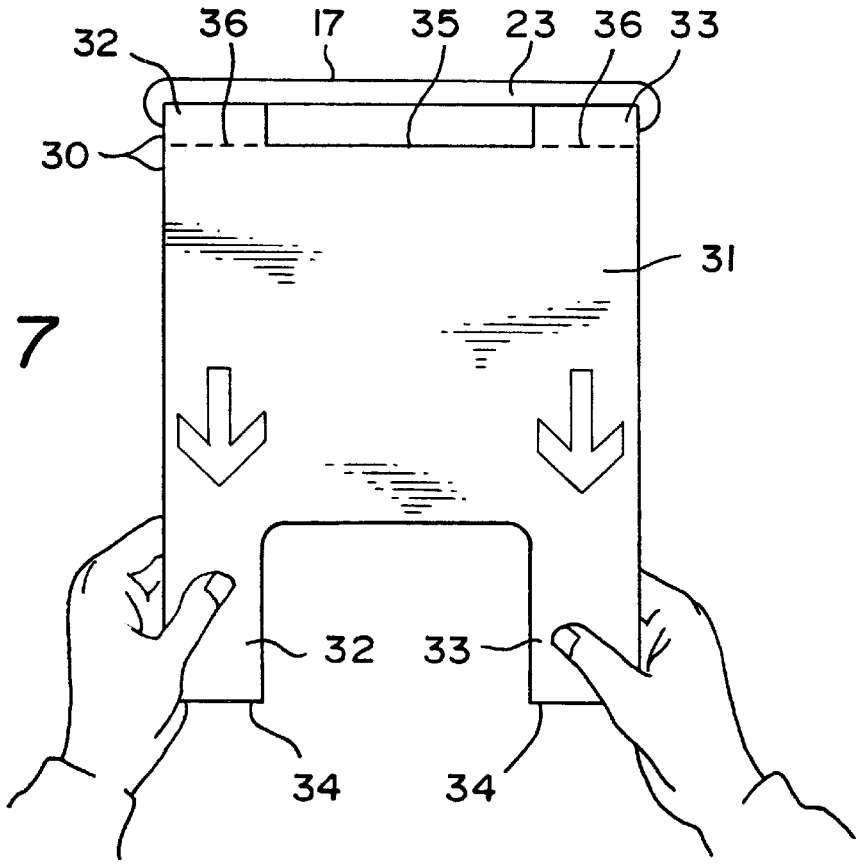
FIG. 7
FIG. 8
FIG. 9
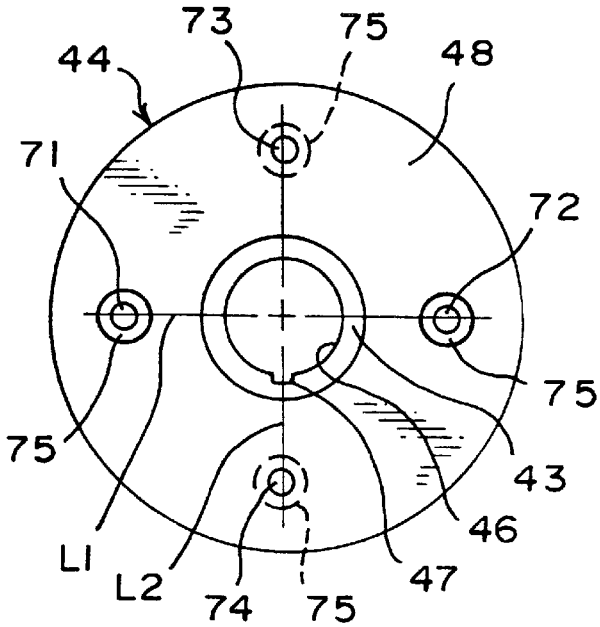
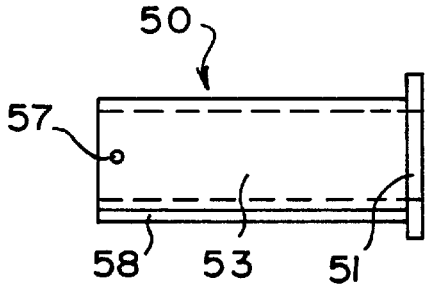
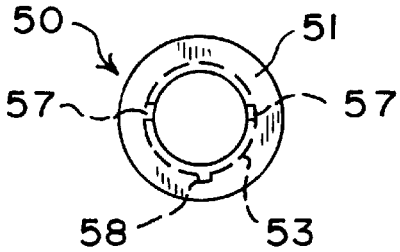
FIG. 10

DISPENSING DEVICE FOR BAGS

This application is a continuation of application Ser. No. 08/190,003, filed as PCT/CH93/00121, May 13, 1993, now abandoned.

The present invention relates to a dispensing device for bags, with a housing in which a supply of bags is disposed, and with at least one gap which is formed in one of the walls of the housing and through which the bags can leave the housing.

A dispensing device of this generic type is disclosed, for example, in CH-C 474 232. This dispensing device has a rear wall, and carrying elements for fastening a reserve container for rolled-up plastic sacks project from the lateral edges of this rear wall. In the reserve container there is a trough-shaped bottom, on which the roll of plastic bags lies. The plastic bags may be pulled out through a slit-shaped aperture in the reserve container and may be separated off from the rest of the supply of plastic bags at a serrated tear-off edge of the container.

This previously known dispensing device has several disadvantages. The pull-out of the bags from the supply is unretarded, so that more than one bag may be pulled out of the container if the bag web is not pulled carefully enough. After more bags have been pulled out of the container than are needed, it is virtually impossible in the case of this device to roll the roll back to accommodate the excess bags in the container again.

A further disadvantage of this previously known device consists in the fact that it cannot be set up outdoors. One of the reasons preventing this is the aforementioned open gap on the supply container. This gap cannot be sealed against the penetration, for example, of rainwater. The bags are made of plastic. It is known that plastic adheres relatively firmly to smooth and wet surfaces, such as, for example, to the surface of a piece of metal. Rainwater, for example, in the aforementioned housing or in the trough with the bag roll would cause the outside of the bag located directly in the circumferential region of the roll to remain strongly adhered to the wet surface of the trough. The supply roll would exert an irregular resistance during pull-out of the bags, so that a plurality of bags might be unintentionally pulled out of the container, with the above-described disadvantageous consequences.

The object of the present invention is to eliminate this and also further disadvantages of the prior art.

This object is achieved according to the invention in the case of the device of the generic type mentioned at the outset, as is defined in the characterizing part of claim 1.

Figure 1:
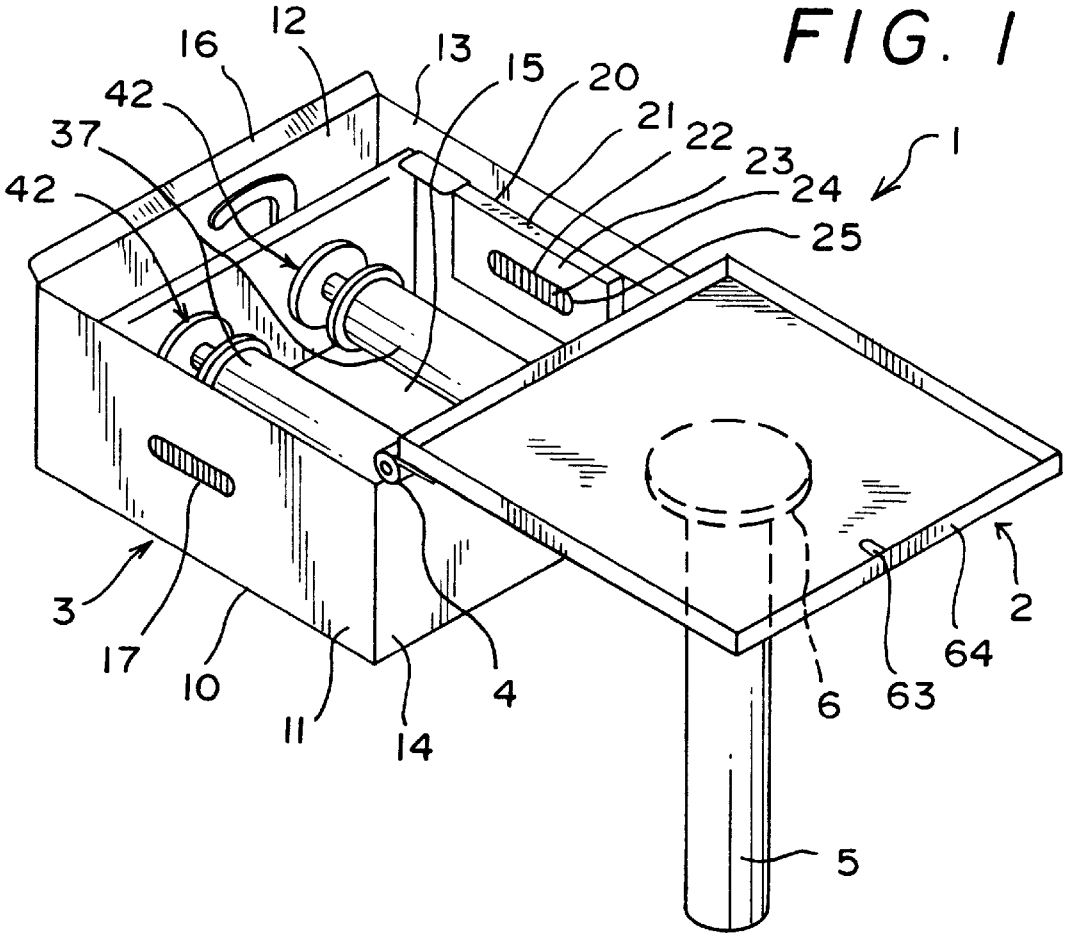
Figure 2:
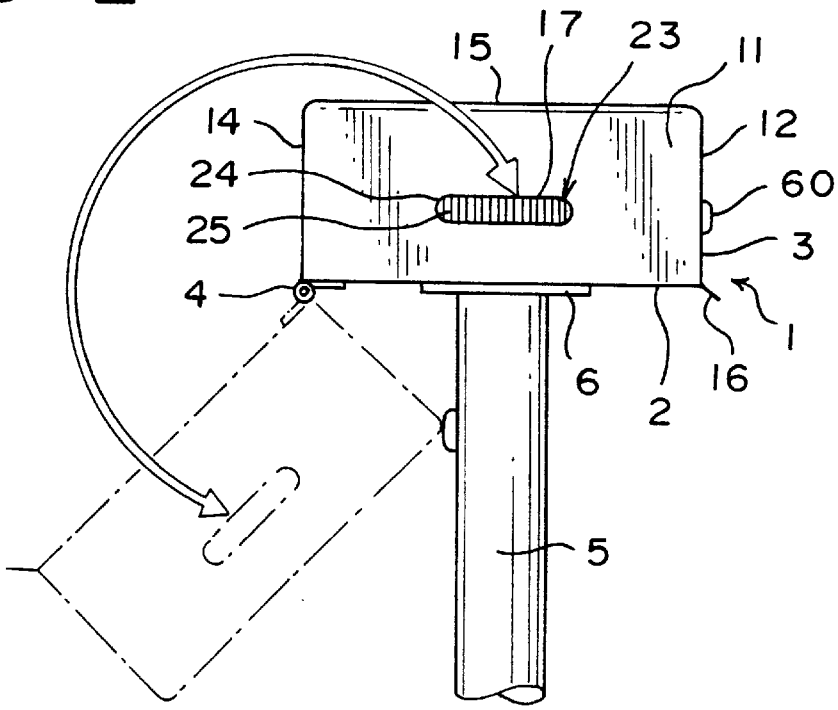
Figure 5:
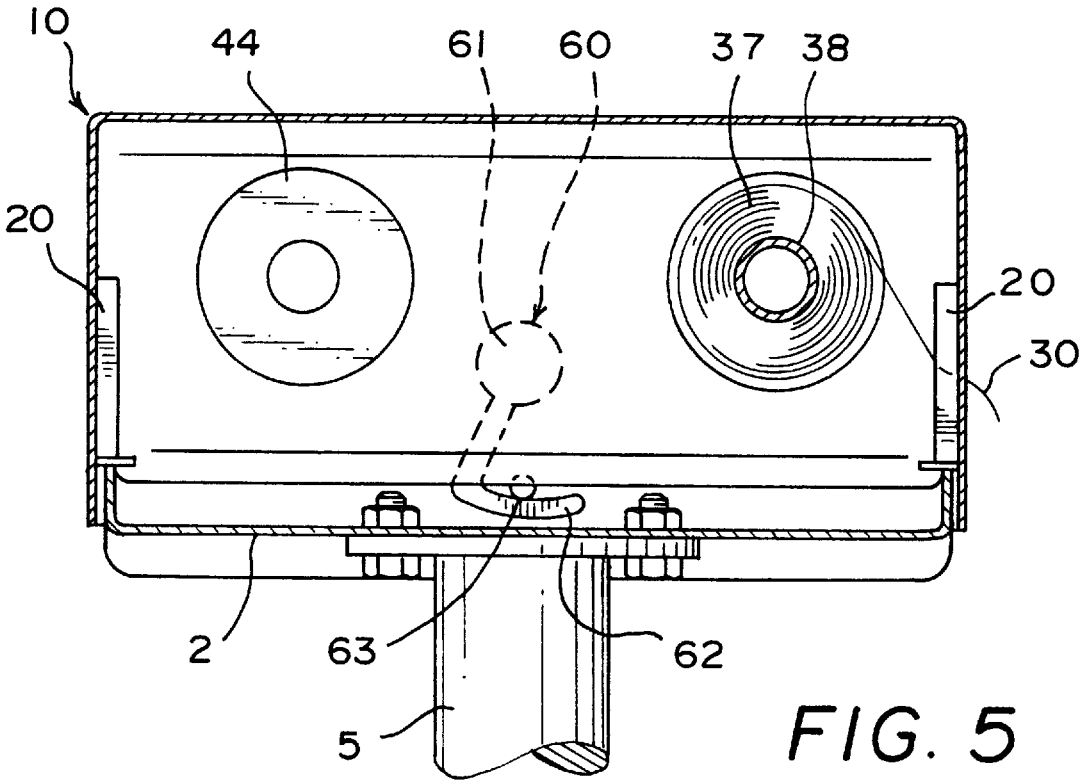
Figure 6:
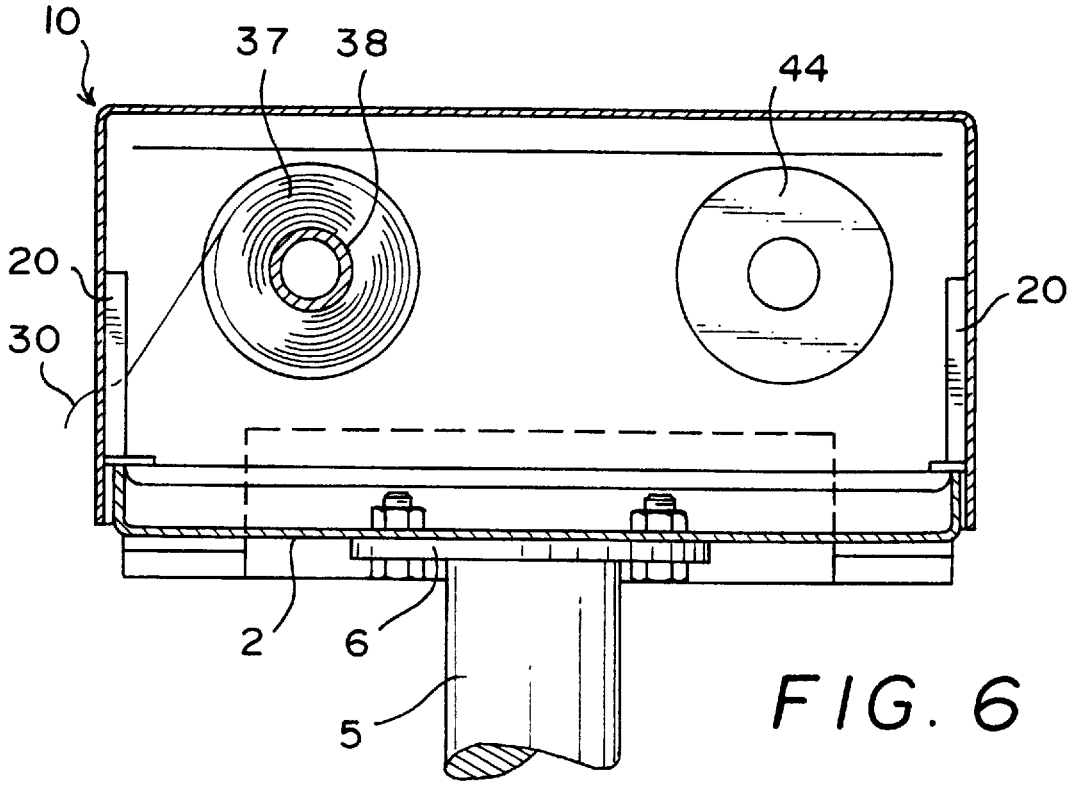
Figure 11:
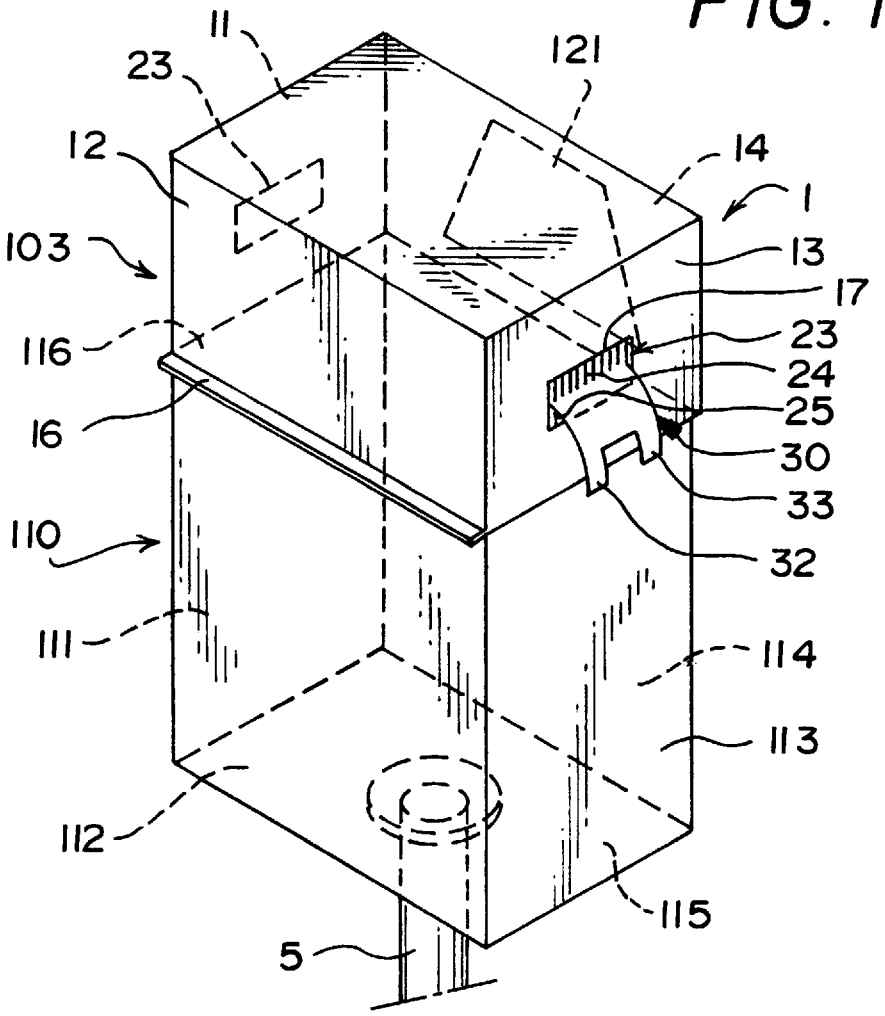
Figure 12:
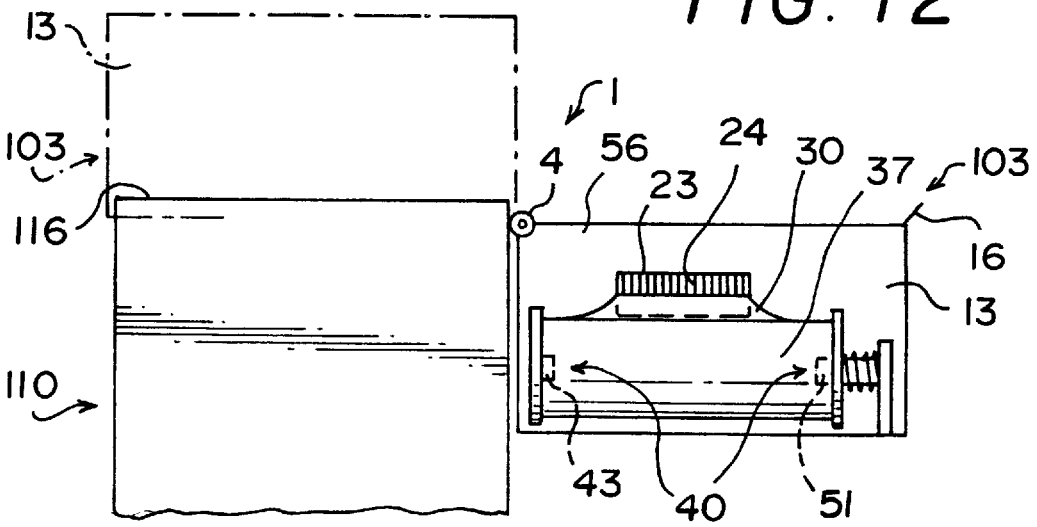

Embodiments of the present invention are explained in greater detail below with the aid of the accompanying drawings, in which:

FIG. 1 shows a perspective view of the present device after the upper part thereof has been folded away laterally, FIG. 2 shows a side view of the device according to FIG. 1 when it is in the ready-to-use state, FIG. 3 shows a top view of the interior of the upper part of the device according to FIG. 1 when the upper part thereof is in the aforementioned folded-away position, FIG. 4 shows a vertical section IV—IV of the upper part of the device according to FIG. 4 [sic] when it is in the ready-to-use state, FIG. 5 shows a section V—V of the device according to FIG. 1 or 4, respectively, this section being taken perpendicularly to the longitudinal axis of supply rolls with bags, FIG. 6 shows a vertical section VI—VI through the present device, which is rotated through 180 degrees with respect to the section V—V according to FIG. 5, FIG. 7 shows bags which have been pulled out of the device from one of the supply rolls, FIG. 8 shows a top view of an end disc, on which one of the supply rolls bears at one end, FIG. 9 shows a side view of a bolt on which the end disc according to FIG. 8 can be seated, FIG. 10 shows a front view of the bolt according to FIG. 9, FIG. 11 shows a perspective view of a further embodiment of the present device, and FIG. 12 shows a side view of the device according to FIG. 11 after the upper part of this device has been folded away laterally.

FIG. 1 of the accompanying drawings shows a perspective view of the present device and FIG. 2 shows a side view of this device. The present dispensing device has a housing 1. This housing 1 consists essentially of two parts and comprises an essentially horizontally lying base plate 2 and an upper part 3. The upper part 3 is assigned to the base plate 2 and is articulatedly mounted on the base plate 2 with the aid of a hinge 4.

On the underside of the base plate 2, a plinth 5 is attached. In the case illustrated, the plinth 5 is designed as a column whose upper end is attached to the base plate 2 with the aid of a head plate 6. The lower end of the column 5 is designed corresponding to the particular situation. This end part of the column 5 may be smooth if the column 5 is to be sunk into the earth or the like. This end part of the column 5, however, may also be provided with a sole plate (not illustrated), if the column 5 is to be screwed, for example, to the substrate.

The housing upper part 3 comprises a container 10 which is open at one side and thus has an opening in this region. This container 10 has four side walls 11, 12, 13 and 14 and a bottom 15. The hinge 4 is connected at one side to the free edge of one of the side walls 14. The other side of the hinge 4 is connected to one of the edges of the base plate 2. The free edge of the opposite container side 12 is provided with a material strip 16 which projects obliquely from the container body or container jacket and is intended to facilitate the opening of the housing 1.

The side walls 11 to 14 and the bottom 15 together form one piece and such a container jacket is made of an impact-resistant material, for example aluminum, plastic or the like. In the ready-to-use state, the container lies with its opening on the base plate 2, so that the container jacket covers the contents of the housing 1 in the manner of a lid. The interior of the housing 1 is protected by a container jacket of such a design against the penetration of water, dirt, etc.

In at least one of the container walls 11 to 14, there is formed an elongate aperture 17 to which a dispensing slot 20 is assigned. The aforementioned assignment is carried out such that the slot 20 covers the aperture 17 from the outside or from the inside. The slot 20, assigned to the aperture 17 as described, prevents to a large extent rainwater, dirt and other objects from passing into the interior of the housing 1.

The slot 20 is designed as an independent unit which can be attached to the wall 11 to 14 of the container 10. The slot 20 has a hollow, dish-shaped lid 21 in the bottom of which an elongate aperture 22 running virtually in a straight line is produced. The edges of this elongate aperture 22 extend virtually parallel to one another, specifically at a distance from one another which is considerably larger than the thickness of an empty bag to be dispensed. This distance is slightly larger than the thickness of a finger. This permits easy passage of the first bag through this aperture 22, after, for example, a new roll with bags has been inserted into the container 10.

The lid aperture 22 of the slot 20 has assigned to it a braking member 23, such that this member 23 bears against the inside of the cover 21. The braking member 23 comprises two sections or lips 24 and 25 which interact during the dispensing of the bags. Each of these lips 24 and 25, respectively, has elongate elements which extend virtually parallel to one another and stand perpendicular to the longitudinal direction of the aperture 22, and are held in a mounting at one end. The other ends of such elements are freely movable.

The lips 24 and 25 may be designed similarly to a brushe, bristles representing the effective elements of the lips 24 and 25. At one of their ends, the bristles are held in the mountings. The other ends of the bristles project from the mountings and act on the particular bags located between said bristles. The effective elements of the lips 24 and 25, however, may also be designed as strips of a compliant material, such as, for example, rubber or a plastic. The dimensions or/and the number of the braking elements in the respective lip 24 and 25 are chosen depending on the stiffness of the braking elements and depending on the magnitude of the force necessary to tear off the foremost bag. It goes without saying that the lips 24 and 25 of a braking member 23 may be differently designed.

The lips 24 and 25 of the braking member 23 are arranged such that the mountings lie on the outside and the free ends of the braking elements lie in the centre of the braking member 23. The distance between the lips 24 and 25 is designed such that the free ends of the braking elements stand at a small distance from one another or that they even lie one on top of the other. The lips 24 and 25, however, may also be arranged such that the free end part [sic] of the braking elements of one lip 24 or 25, respectively, reach as far as the region of the free end parts of the braking elements of the opposite lip 25 or 24, respectively.

In the interior of the container 1, there is located a supply of bags to be dispensed. The bag (FIG. 7) in question has the form of a T-shirt and it has a sack-shaped basic body 31. In the region of the opening of the bag basic body 31, loops 32 and 33 are connected to the basic body 31 and may serve for carrying the filled bag 30.

The bags 30 are connected one behind the other and form a web. In this web, the front edge 34, in each case, of the loops 32 and 33 is connected to the bottom edge 35 of the bag basic body 31. At the transition between the loops 32 and 33, respectively, and the bottom 35 of the adjacent bags 30, a perforation 36 is formed, which extends virtually along the sack bottom edge 35. This perforation 36 represents a predetermined tear point, to achieve a neat separation of the bags 30 from one another in the present device. On the other hand, the force necessary for tearing off the particular foremost bag from the subsequent bag for a given braking force of the braking member 23 may be controlled by an appropriate design of the perforation.

The bag web is rolled up to form a roll 37 (FIG. 3), which is wound on a tubular core 38 (FIG. 5) of cardboard or the like. In the present case, two rolls 37 are located in the container 10. Each of these rolls 37 is assigned to one of the side walls 11 and 13, respectively, (FIG. 3) of the container 10. The elongate aperture 17 is formed in each of these side walls 11 and 13, respectively, and these apertures 17 have assigned to them in each case a dispensing slot 20 in the manner described above. The gap which is available for the passage of the bags 30 between the lips 24 and 25 of the dispensing slot 20 runs in a straight line and the length of this gap is shorter than the width of the bags 30 located in the supply pack 37.

So that it is ensured that the resistance of the roll 37 during rotation thereof is independent of the weather, for example, the roll 37 must be supported so as to be rotatable in the housing 1. In addition, this support has to be designed such that the rolls 37 can be exchanged as easily and simply as possible. Devices 40 for the support of the rolls 37 in question are provided, which devices 40 are arranged in the container 10 and move, together with the device upper part 3, with respect to the base plate 2 of the device or can be pivoted about the hinge 4. This pivoting of the upper part 3 allows access to the interior of the upper part 3 through the opening thereof, which in the ready-to-use state of the device is disposed at the bottom and lies on the base plate 2. In the folded-away state, the interior of the upper part or of the container 10 is even accessible from above, so that the exchange of rolls 37 can be carried out without any problems at all.

The support devices 40 are arranged in the interior of a frame 26 (FIG. 3) which has two approximately U-shaped sections 27 and 28. The webs 39 of the U-shaped frame sections 27 and 28 are at a distance from one another and extend virtually parallel to one another. They are sufficiently long that the legs 29 of the frame sections or frame halves 27 and 28 bear against the inside of the side walls 11 and 13 of the container 10. The legs 29 of the U-shaped frame sections 27 and 28 are shorter than half the length of those container sides 11 and 13, respectively, which bear the dispensing slot 20 in question. The length of the legs 29, however, is chosen such that the end parts of these legs 29 overlap the edge parts of the dispensing slots 20. This makes it possible to attach the mutually overlapping sections of the slot 20 in question and of the frame leg 29 in question to the container body 10 with the aid of a screw 19 or rivet.

The web 39 of the frame part 28 located closer to the rear side 14 of the container 10 bears virtually tightly against the inside of this container rear wall 14. The distance between the webs 39 of the frame halves 27 and 28 is determined especially or essentially by the length of the supply roll 37, which extends or is intended to extend between these webs 39. The length of the side walls 11 and 13 of the container 10, to which the slots 20 are fastened, is considerably larger than the length of the bag rolls 37, so that a hollow space 45 is present between the web 39 of the frame half 27 located closer to the front wall 12 of the container 10 and said front wall 12.

For the support of a roll 37, the support device 40 has two support points 41 and 42. One of these support points 41 is fixed, whereas the other support point 42 is designed so as to be compliant, so that a new supply roll 37 can be inserted into the support device 40, or the roll core 38 may be removed from this support device 40.

The fixed support point 41 has a disc 44 against which the supply roll 37 can bear at its end face or at one end, and whose diameter is slightly larger than the outer diameter of a supply roll 37 which has not yet been opened. This end disc 44 is illustrated in FIG. 8 in top view. The outer edge of the basic body 48 of this disc 44 has a circular contour. In the centre of the disc basic body 48, an aperture 46 with a contour which is also circular is formed.

The centre aperture 46 in the disc basic body 48 is surrounded by an annular bead 43 which projects from the basic body 48 and which may be integrally moulded on this basic body 48. The outer circumferential surface of this circular bead 43 has a diameter which is slightly smaller than the inner diameter of the aperture in the roll core 38. This is so that one of the end parts of the roll core 38 can be plugged onto this bead 43. In the wall of the disc aperture 46, a groove 47 is formed, whose longitudinal axis extends parallel to the axis of the centre aperture 46 in the disc 44.

In the plate-shaped basic body 48 of the disc 44, pairs of continuous bores 71 and 72 and 73 and 74 are formed, whose axes also extend parallel to the axis of the centre aperture 46 in the disc basic body 48. These bores 71 to 74 are located at equal distances from the centre of the disc body 48. The bores of the pair in question lie diametrically opposite one another. Lines L1 and L2, which connect the bores 71 and 72 and 73 and 74 of the pair in question, are perpendicular to one another. The starting part of the bore in question is provided with a countersink hole 75, in which the head of a fastening screw can be located. In the case of one pair of the bores 71 and 72, the countersink holes 75 are located on one side of the disc body 48, whereas in the case of the other pair of the bores 73 and 74, the countersink holes 75 are located on the opposite side of the disc body 48. This design of the disc makes it possible to use the same design of disk 44 for the two support points 41 and 42.

The end disc 44 of the fixed support point 41 is fastened on the inside of first wall 391 of the rear frame half 28 with the aid of a pair of screws (not illustrated), in such a manner that the bead 43 on this disc 44 faces away from the afore-mentioned frame half 28. In this case, the screws pass through one of the pairs of the diametrically opposite bores 71 and 72 or 73 and 74 in the disc basic body 48, the heads of these screws being countersunk in the countersink holes 75 of the outside of this disc 44. As a consequence, that edge of the supply roll 37 bearing against this outside of the disc 44 can slide unhindered on this disc side if a further bag is pulled off from the supply roll 37. In the process, the bead 43 on the disc basic body 48 centres this end of the supply roll 37 with respect to the end disc 44.

The compliant support point 42 of the support device 40 has two discs (441, 442) identical to disk of the above-described design and an essentially cylindrical bolt 50 (FIG. 3). This bolt 50 is shown in a side view in FIG. 9 and in a front view in FIG. 10. It has a cylindrical basic body or centre part 53. This bolt basic body 53 is hollow and the outer diameter of this basic body 53 is slightly smaller than the diameter of the centre aperture 46 in the disks 441, 442, so that the bolt body 53 can be pushed through the centre aperture 46 in the disks 441, 442 in question with a small amount of play. On the outside of the bolt basic body 53, a ridge 58 is formed which projects from the outside of the bolt body 53 or is elevated above this and extends in the axial direction of the bolt body 53. This ridge 58 comes to lie in the groove 47 in the centre aperture 46 when the bolt body 53 passes through the disks 441, 441. The disks 441, 442 are thus prevented from rotating on the bolt 50.

At one end of the cylindrical bolt body 53, a collar 51 is located. This collar 51 may be integrally moulded on this bolt end and by this means be integral with the rest of the bolt 50.

Disk 441 of this compliant support point 42 is attached to second wall 392 (opposing first wall 391) located in the frame half 27 disposed closer to the front side 12 of the container 10. This attachment, in the same way as in the case of the disc 44 of the fixed support point 41, is carried out with the aid of two screws (not illustrated), which pass through two of the bores 71 and 72 or 73 and 74 disposed diametrically opposite one another, the heads of these screws being countersunk in the relevant countersink holes 75. This disc 441 is mounted on the inside of the frame half 27. In this frame half 27, an aperture is formed whose diameter is slightly larger than the outer diameter of the bead 43 on disk 441. The disc 441 mounted on this frame half 27 is oriented such that its bead 43 is located in the aperture of this frame half 27. The bolt 50 is inserted into this disc 441 such that its collar 51 bears against the outside of the frame half 27, that is to say in the hollow space 45 of the container 10, and that it can also move in this space 45. Since the ridge 58 is located in the recess or in the groove 47 of the disc 441 in question, although the bolt 50 can move in its longitudinal direction in the aperture 46 of the disc 441, it cannot rotate in this aperture 46.

At the opposite end of the bolt 50, which is located in the roll space 56, the second of the aforementioned discs 442 of this compliant support point 42 is arranged. This disc 442 is oriented such that the bead 43 on this end disc 442 faces the interior of the roll space 56 or of the frame. The end face of the bead 43 expediently lies in the same plane as the end face of this end part of the bolt basic body 53. In this end part of the bolt 50, specifically at the point at which the bead 43 of the disc 442 is located, there is formed a bore 57 (FIG. 9). A corresponding transverse bore is formed in the bead 43. The transverse bores in the bead 43 and in the bolt body 53 are brought into alignment and a heavy-type dowel pin is pushed through these apertures. By this means, this inner disc 442 is attached to the bolt body 53 and secured against displacement along the bolt body 53. The disc 441 is secured against rotation with respect to the bolt body 53 with the aid of the ridge 58 on the bolt body 53, whose corresponding section is located in the groove 47 of the bead aperture 46.

That section of the bolt body 53 which extends between the two discs 441, 442 of this compliant support point 42 is surrounded by a helical spring 54. This helical spring 54 is supported at one end on the inside of the end disc 441 attached to the front frame half 27. The other end of the compression spring 54 is supported on the inside of the other end disc 442, which is located on the inner end of the bolt 50. The diameter of the helical spring 54 may in some circumstances be noticeably larger than the outer diameter of the bolt body 53. For centring the position of such a spring 54 with respect to the bolt body 53, the disc 441 and/or 442 may be provided with a second bead (not illustrated). This bead is designed so as to be virtually identical to the first bead 43 described above. However, this second bead is arranged on that side of the disc basic body 48 opposite the first bead 43. In FIG. 8, the second bead is located behind the first bead 43 which is visible in FIG. 8. The outer diameter of the second bead corresponds to the inner diameter of the helical spring 54, so that this bead may be located in one of the end parts of the helical spring 54 and by this means may hold this spring 54 at a predetermined distance from the bolt body 53.

If a bag roll 37 is to be inserted into the container, first of all one end of this roll 37 is placed onto the bead 43 on the inner roll disc 442. Then the supply roll 37 is pressed onto this roll disc 442, approximately in the axial direction of the bolt 50, so that the bolt 50 which is connected to this disc 442 via the heavy-type dowel pin is displaced outwards, that is to say into the interspace 45. Then the other end of the roll 37 may be lowered to such an extent that this roll end can be pushed onto the bead 43 of the end disc 44 of the fixed support point 41. After this, the first bag 30 may be introduced from this supply roll 37 into the slit in the slot 20, and by this means this roll 37 is ready for use.

The present device is equipped with support devices 40 for two supply rolls 37 and with two dispensing slots 20. In the case illustrated, the supply rolls 37 are arranged parallel to one another and the slots 20 are assigned to the mutually opposite side walls 11 and 13 of the container.

The rear wall 12 of the container 10 is provided with a lock 60. This lock 60 comprises a cylinder 61 of a known design which passes through the rear wall 12. At that end of this cylinder 61 which is located in the interspace 45, there is attached a hook 62 which can engage behind a pin 63 which is attached to the base plate 2 of the housing 1. The edge 64 (FIG. 1) of the base plate 1 [sic] is bent upwards and the pin 63 is attached to the inside of this edge part of the base plate 2. With the aid of a special key, for example a key with an aperture of triangular cross-section, the hook 62 of the lock 60 may be pivoted and by this means may be brought into or out of engagement with the pin 63.

FIGS. 11 and 12 show a further possible embodiment of the present device, FIG. 11 showing a perspective view of this device. FIG. 12 shows a side view of the present device after the upper part of this device has been folded away laterally.

This embodiment of the present device also comprises two parts and has an upper part 103 and a lower part 110. The upper part 103 of this device is extremely similar to the upper part 3 of the device according to FIG. 1. One difference with respect to the upper part 3 according to FIG. 1 is an aperture 121 which is formed in one of the side walls and advantageously in the front wall 14 of the upper part 103. This aperture 121 is located approximately in the centre of the width of the container wall 14 and thus is disposed between the supply rolls 37 described above. This aperture 121 thus opens into the roll space 56 in the upper part 103.

The lower part 110 of this device is designed as a hollow body which is open at one side. In the case illustrated, the lower part 110 is virtually cuboidal, although it may also be cubic or the like. The most important condition for the shape of the lower part is that it has an aperture or opening 116 which can be covered by the upper part 103 and by means of which the hollow space 56 in the upper part 103 and the hollow space in the lower part 110 are connected to one another.

The lower part 110 (FIG. 11) has side walls 111, 112, 113 and 114 and a bottom 115. To the outside of the bottom 115, the plinth 5 described above is connected and projects virtually at right angles from this bottom 115. Instead of the plinth designed as a supporting leg or as a column, a bracket (not illustrated) may be connected to the bottom 115, so that such a device may also be attached or fastened to a wall. In its upper region, the lower part 110 has an opening 116 which lies virtually in a horizontal plane and can be covered by the upper part 103. The edge part of the upper part 103 is assigned to the edge part of the lower part 110 such that the opening in the container 10 of the housing upper part 103 is seated on the opening 116 of the housing lower part 110. For this purpose, the horizontal sections taken through the upper part 103 and the lower part 110 have virtually the same shape and virtually the same dimensions. The edge of a sack, for example a refuse sack (not illustrated), the remainder of which is located in the interior of the lower part 110, may be clamped between the edges of the upper part 103 and of the lower part 110. Articles which are to be deposited in such a device are dropped into the interior 56 of the housing upper part 103 through the aperture 121 in the housing upper part 103. Such articles then pass in free fall through the opening 116 of the lower part 110 into said lower part, and thus also into the sack. When the lid 103 is opened, the lower part aperture 116 is exposed, so that the lower part 110 can be emptied.

The upper part 103 is connected to the lower part 110 so as to be pivotable, with the aid of the above-described hinge 4, so that the upper part can be folded away laterally from the lower part, as is illustrated in a side view in FIG. 12. In this position of the upper part 103, the support points for the bag rolls are located on the upper side of the housing upper part 3 or 103, respectively. In the upper part 103, there is no cover for the supply rolls 37 with respect to the remainder of the interior 56 of the upper part 103. As a consequence, the interior space of this upper part 103 is readily accessible for exchanging the bag rolls 37, cleaning the interior of the upper part or the like. The fact that the bag rolls 37 and the support points thereof are exposed in the interior space of the device makes possible problem-free access to said bag rolls 37 and the support points, if this is necessary. In the present device, both hands are free for exchanging the rolls 37.

The presence of the aforementioned loops 32 and 33 on the bags also provides the significant advantage that the loops 32 and 33 can be knotted, so that the opening in the bag basic body can be closed by this means.

I claim:

1. A bag dispenser comprising:

a) a housing including a first wall, a second wall opposing the first wall, and a third wall including at least one slot;

b) enclosed within said housing at least one bag supply comprising connected bags rolled on a tubular core having opposing ends, one of said ends facing the first wall, the other of said ends facing the second wall; and c) a device mounted inside the housing comprising a pair of holders (41,42) for the at least one bag supply (40), each of said holders supporting an opposing end of said tubular core, one of said holders (41) being rigidly attached to the first wall (391), and the other of said holders (42) being resiliently attached to the second wall (392);

wherein said holders (41,42) are non-rotatable;

wherein the rigid holder (41) comprises a disc (44) including a disc body (48) having an aperture (46) in the centre region thereof and having a first annular bead (43) surrounding said aperture (46) on one side of the disc body (48) whereby said disc (44) is attached to the first wall (391) of the housing;

wherein the resiliently attached holder (42) comprise; a first disc (441) and a second disc (442), each of said discs including a disc body (48) having an aperture (46) in the centre region thereof, one side of the disc body (48) being provided with a first annular bead (43) surrounding the aperture (46) in the disc body (48), whereby the first disc (441) of resiliently attached holder (42) is attached to the second wall (392) of the housing;

wherein a bolt (50), which includes a cylindrical body (51) is disposed in non-rotatable manner in the apertures (46) in the first and second discs (441,442) whereby one end of said cylindrical body (51) is secured to the second disc (442) of the resiliently attached holder (42); and wherein a helical compression spring (54), surrounding the cylindrical body (51) of the bolt (50), is placed between the first and second discs (441,442) of the resiliently attached holder (42).

2. The dispenser of claim 1, wherein the disc body includes bores having axes parallel to the aperture axis.

3. The dispenser of claim 2, wherein the bores are equidistant from the aperture, the bores are arranged in pairs with the bores of each pair being diametrically opposite one another about the aperture, and each bore has a countersink hole, the countersink holes of one pair of bores located on one side of the disk body, and the countersink holes of another pair of bores located on the opposite side of the disk body.

4. The dispenser of claim 1, wherein the rigid holder comprises one disk oriented with the side carrying the first annular bead facing the resiliently maintained holder.

5. The dispenser of claim 1, wherein the means for retaining the second disc on the bolt comprises: a transverse bore in the cylindrical body; a corresponding transverse bore in the bead on the second disc; and a pin held in place through the transverse bores in the body and the bead.

6. The dispenser of claim 1, wherein each of the first and second discs, on sides facing each other, carries a second annular bead, about which second annular beads fit inner diameters of opposing ends of the helical compression spring, maintaining the spring in position on the first and second discs.

7. A dispenser of claim 1, wherein the first and second discs (441,442) of the resiliently maintained holder (42) are oriented such that one side of the first disc (441) which bears the annular bead (43) faces away from the other disc (442) and that one side of the second disc (442) which bears the annular bead (43) faces away from the other disc (441).

8. A dispenser of claim 7, wherein the bolt further includes on the cylindrical body, an axially oriented external ridge seated in a groove in the apertures of the first and second discs, preventing rotation of the discs on the cylindrical body; around the cylindrical body, an annular collar retains the first disc of the resiliently maintained holder in the region of the annular bead on this first disc; and means for retaining the second disc on the bolt in the region of the annular bead of the second disc are foreseen.

9. A bag dispenser comprising:

a) a housing including a first wall, a second wall opposing the first wall, and a third wall including at least one slot;

b) enclosed within said housing at least one bag supply comprising connected bags rolled on a tubular core having opposing ends, one of said ends facing the first wall, the other of said ends facing the second wall; and c) a device mounted inside the housing comprising a pair of holders for the at least one bag supply, each of said holders supporting one of said opposing ends of said tubular core, one of said holders being fixed relative to the housing and the other of said holders being resiliently maintained relative to the housing;

d) a frame attached to the housing on which is mounted the device, the frame comprising two approximately U-shaped sections, each section including a web and two legs, said webs disposed parallel to each other, one of said webs being parallel to the first wall of the housing, and the other of said webs being parallel to the second wall of the housing, the rigid holder being attached to the web parallel to the first wall, and the resiliently maintained holder being attached to the web parallel to the second wall, the legs of said sections being attached to the inside of the housing.

10. The dispenser according to claim 9, wherein the web parallel to the second wall is maintained at a distance from the second wall creating a space between the web and the second wall, permitting the bolt of the resiliently maintained holder to move between the web and the second wall.

11. The dispenser according to claim 10, wherein the third wall is perpendicular to the first and second walls, the lengths of the legs of the U-shaped sections are less than one half the length of the third wall, and corresponding legs of the U-shaped sections are attached to the third wall such that the end part of each leg overlaps one of the edge parts of the slot.

12. The dispenser according to claim 10, wherein the web attached to the rigid holder is closer to the first wall than the web attached to the resiliently maintained holder is attached to the second wall.

13. The dispenser according to claim 10, wherein the web parallel to the second wall includes an aperture having a diameter in which sits the second annular bead on the second disk of the resiliently maintained holder.

* * * * *